US005348095A

United States Patent [19]

Worrall et al.

[11] Patent Number: 5,348,095

[45] Date of Patent: Sep. 20, 1994

[54] METHOD OF CREATING A WELLBORE IN AN UNDERGROUND FORMATION

[75] Inventors: Robert N. Worrall; Wilhelmus C. M. Lohbeck; Paul R. Choate, all of Rijswijk; Martin Donnelly, Arnhem, all of Netherlands

[73] Assignee: Shell Oil Company, Houston, Tex.

[21] Appl. No.: 72,288

[22] Filed: Jun. 7, 1993

[30] Foreign Application Priority Data

Jun. 9, 1992 [EP] European Pat. Off. ..... 92201670.4

[51] Int. Cl.[5] ..... E21B 17/00

[52] U.S. Cl. ..... 166/380; 166/384

[58] Field of Search ..... 166/380, 384

[56] References Cited

U.S. PATENT DOCUMENTS 1,135,809 4/1915 Jones .
1,233,888 7/1917 Leonard .
2,447,629 8/1948 Biessinger et al. .
3,191,680 6/1965 Vincent .
3,353,599 11/1967 Swift .
3,477,506 11/1969 Malone .
3,693,717 9/1972 Wuenschel .
3,945,444 3/1976 Knudson .
4,977,958 12/1990 Miller .

FOREIGN PATENT DOCUMENTS

0377486A2 7/1990 European Pat. Off. .
353309 7/1989 Fed. Rep. of Germany .
397874 5/1990 Fed. Rep. of Germany .
397875 5/1990 Fed. Rep. of Germany .
61-067528 4/1986 Japan .

*Primary Examiner*—William P. Neuder

[57] ABSTRACT

A method of creating a wellbore in an underground formation is provided. A borehole is drilled in the underground formation, whereafter a casing of a ductile material is lowered into the borehole. The casing is selected to have a smaller elastic radial deformation than the surrounding formation when the casing is radially expanded against the borehole wall by application of a radial force to the casing. Said radial force is applied to the casing so as to radially expand the casing against the borehole wall thereby inducing a plastic radial deformation of the casing and an elastic radial deformation of the surrounding underground formation, whereafter the radial force is removed from the casing.

8 Claims, 2 Drawing Sheets

FIG. 5
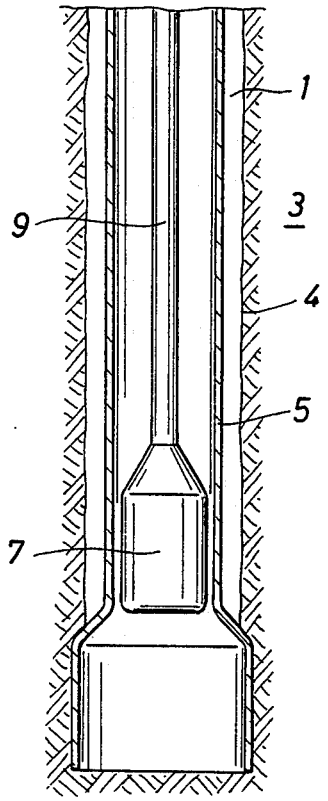
FIG. 6
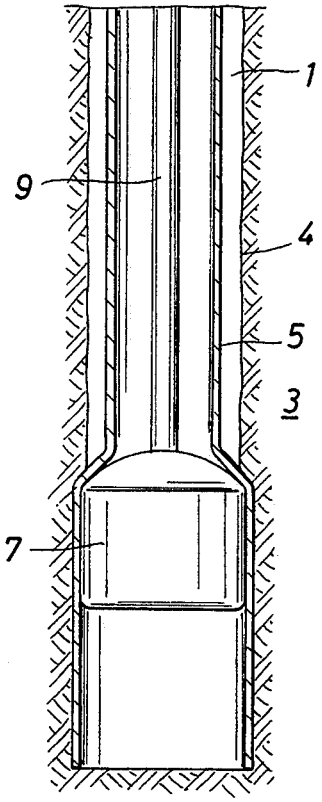
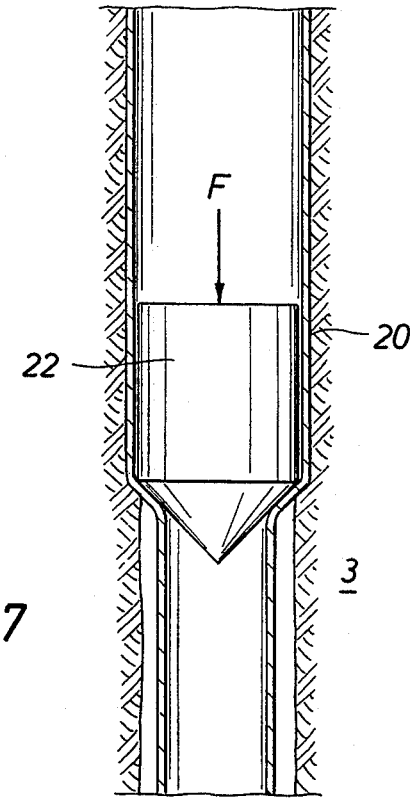
FIG. 7

METHOD OF CREATING A WELLBORE IN AN UNDERGROUND FORMATION

FIELD OF THE INVENTION

The invention relates to a method of creating a wellbore in an underground formation, for example a wellbore for the production of oil or gas.

BACKGROUND OF THE INVENTION

Generally, when a wellbore for oil or gas production is created, a number of casings are installed in the borehole. These casings serve to prevent collapse of the borehole wall and to prevent undesired outflow of drilling fluid into the formation or inflow of fluid from the formation into the borehole from strata other than the target production strata. The borehole is drilled in intervals whereby each casing is installed after drilling of a next interval, so that a next casing to be installed is to be lowered through a previously installed casing. In a conventional method of creating a wellbore the outer diameter of the next casing is limited by the inner diameter of the previously installed casing in order to allow lowering of the next casing through the previous casing. Thus, the casings are nested relative to each other, with casing diameters decreasing in downward direction. Cement annuli are provided between the outer surfaces of the casings and the borehole wall to seal the annuli between the casing and the borehole wall. As a consequence of the nested arrangement of the casings, a relatively large borehole diameter is required at the upper part of the wellbore. Such a large borehole diameter involves increased costs due to heavy casing handling equipment, large drill bits and increased volumes of drilling fluid. Moreover, increased drilling rig time is involved due to required cement pumping and cement hardening.

It is an object of the invention to provide a method of creating a wellbore in an underground formation, which method eliminates the need for a relatively large borehole diameter in the upper part of the wellbore and thereby overcomes the disadvantages of the conventional method.

SUMMARY OF THE INVENTION

In accordance with the invention there is provided a method of creating a wellbore in an underground formation, the method comprising the steps of: drilling a borehole in the underground formation; lowering a casing of a ductile material into the borehole, the casing having a smaller elastic radial deformation than the surrounding formation when the casing is expanded against the borehole wall by application of a radial force to the casing; applying said radial force to the casing so as to radially expand the casing against the borehole wall thereby inducing a plastic radial deformation of the casing and an elastic radial deformation of the surrounding underground formation; and removing the radial force from the casing.

By expanding the casing in the borehole, the outer diameter of the next casing to be installed is not limited by the inner diameter of the previous casing before expansion thereof. A nested arrangement of the casings is not required. Casings of uniform diameter can therefore be applied in the wellbore. After the radial force is removed, the casing contracts slightly radially inward due elastic relaxation. However, the elastic radial deformation of the formation does not completely vanish following the relaxation because the elastic radial deformation of the formation is larger than the elastic radial deformation of the casing. As a result, a compressive force remains between the casing and the formation after relaxation. This compressive force ensures sealing of the casing to the formation. Cement annuli are no longer required to seal the casings to the formation because of this compressive force.

BRIEF DESCRIPTION OF THE DRAWINGS

FIG. 5 shows the expansion tool of FIGS. 3 and 4 in the unexpanded state as the tool is moved to a next location.

FIG. 6 shows the expansion tool in the expanded state at a second location in the wellbore.

FIG. 7 shows the expansion tool being moved through a casing.

DETAILED DESCRIPTION OF THE INVENTION

The casing of the present invention is made of a ductile material. This implies that the casing material is capable of sustaining plastic deformation. When a steel casing is applied, such casing normally has a smaller elastic radial deformation than the surrounding formation when the casing is expanded against the borehole wall by application of a radial force to the casing.

Preferably the material of the casing is capable of sustaining a plastic deformation of at least 25% uni-axial strain, so that the casing can be sufficiently expanded in the borehole without rupture of the casing material. The casing preferably is an intermediate casing located between a surface casing arranged in an upper part of the wellbore and a production casing arranged in a lower part of the wellbore.

When washouts occur in the borehole during drilling thereof, or when brittle formations am encountered, it may be desirable to pump a sealing material in a fluidic state between the casing and the borehole wall prior to applying said radial force to the casing. The casing is preferably then expanded prior to the time the sealing material set or becomes hard within the wellbore, if such sealing material is one that sets or becomes hard.

Plastic deformation of the casing can be promoted by heating the casing during radial expansion thereof.

A suitable casing joint to be employed for interconnecting two adjacent casings includes a section of a first casing provided with internal annular ribs having an inner diameter slightly larger than the outer diameter of a section of a second casing which extends into said section of the first casing. During expansion of the casing joint, the second casing is pressed against the ribs of the first casing whereby a metal to metal seal is achieved between the sections of the first and the second casing. The ribs allow for some axial contraction of the second casing during radial expansion thereof.

Figure 1:
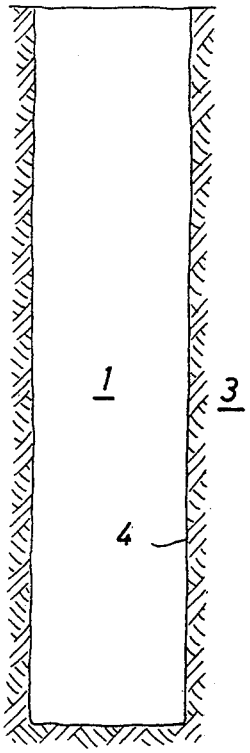
FIG. 1 is a schematic of a longitudinal section of a borehole in an underground formation.
Figure 2:
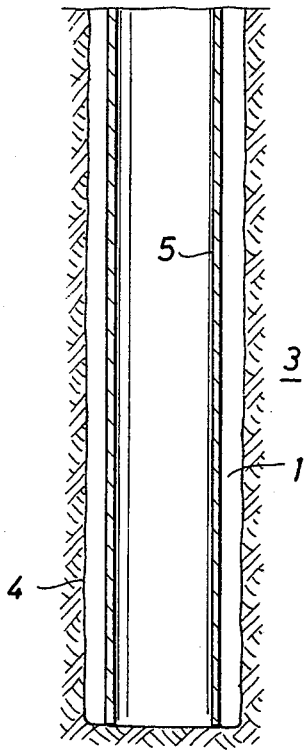
FIG. 2 shows a casing lowered into the borehole of FIG. 1.

Referring now to FIGS. 1 and 2, a borehole 1 is shown, the borehole having been drilled in an underground formation 3, and a cylindrical steel casing 5 of smaller outer diameter than the diameter of the borehole 1. The casing 5 is positioned substantially concentrically in the borehole 1.

Figure 3:
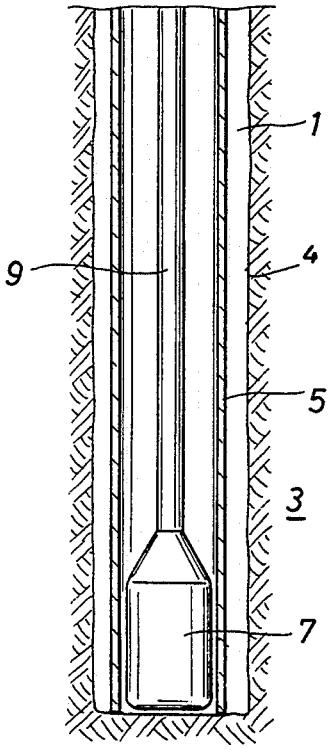
FIG. 3 shows a hydraulic expansion tool in an unexpanded state positioned in a lower section of the casing of FIG. 2.
Figure 4:
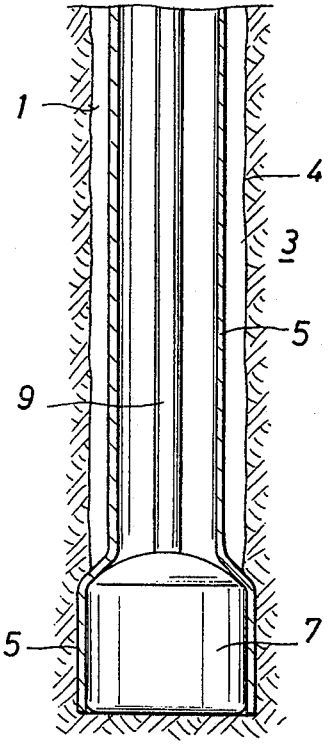
FIG. 4 shows the expansion tool of FIG. 3 in an expanded state.

After the casing 5 has been lowered into the borehole 1, a hydraulic expansion tool 7 is lowered in an unexpanded state into a lower section of the casing 5, as shown in FIG. 3. The expansion tool 7 is connected to a surface pumping facility (not shown) by means of a hydraulic conduit 9. The tool 7 is expanded by operating the surface pumping facility thereby pumping hydraulic fluid through the conduit 9 and into the expander 7, as shown in FIG. 4. Pumping is stopped when the casing 5 at the location of the expansion tool 7 is expanded to in internal diameter slightly larger than the diameter of the borehole 1 as drilled.

During expansion of the casing 5 against the borehole wall 4, the casing 5 undergoes elastic and plastic radial deformation, and the formation 3 surrounding the borehole 1 undergoes at least elastic radial deformation. The elastic radial deformation of the casing 5 is significantly smaller than the plastic radial deformation of this casing, and that the elastic radial deformation of the surrounding formation 3 is significantly larger than the elastic radial deformation of the casing 5.

After expansion of the casing 5 against the borehole wall 4, the hydraulic pressure in the tool 7 is removed allowing the tool 7 to contract to the unexpanded state. This contraction allows some elastic relaxation of the casing. The plastic deformation of the casing 5 remains, so that the elastic deformation of the underground formation 3 in the vicinity of the borehole wall 4 also remains. Thus, a compressive force remains between the casing 5 and the formation 3 due to the remaining elastic deformation of the casing 5.

After a lower section of the casing 5 has been radially expanded in the manner of the present invention, the expansion tool 7 is moved upward through the casing 5 in the unexpanded state and positioned at a next section of the casing 5, whereafter the tool 7 is expanded in order to expand the casing 5 similarly as described above. In this manner the casing 5 is expanded stepwise until the whole casing 5 has been radially expanded. Drilling of the wellbore 1 then proceeds using an underreamer drill bit (not shown), whereafter the next casing (not shown) is lowered through the previously expanded casing 5 to the newly drilled section of the wellbore 1.

The expander 22 shown in FIG. 7 can be used as an alternative to the hydraulic expansion tool 7. When the expander 22 is pushed downward through the casing 20 by an axial force F, the casing 20 is expanded to conform to the outer diameter of the expander 22, which outer diameter is selected such that the desired plastic radial deformation of the casing is achieved.

In an alternative embodiment of the method according to the invention, a section of the interior of the casing in which a fluid is present is closed by means of two packers, whereafter the fluid is pressurized until the desired radial expansion of the casing is achieved. The alternative embodiment can also be used in conjunction with expansion by means of the hydraulic expansion tool or the expander described hereinbefore.

What is claimed is:

1. A method of creating a wellbore in an underground formation, the method comprising the steps of: drilling a borehole in the underground formation; lowering a casing of a ductile material into the borehole, the casing having a smaller elastic radial deformation than the surrounding formation when the casing is radially expanded against the borehole wall by application of a radial force to the casing; applying the radial force to the casing so as to radially expand the casing against the borehole wall thereby inducing a plastic radial deformation of the casing and an elastic radial deformation of the surrounding underground formation; and removing said radial force from the casing.

2. The method of claim 1, wherein the material of the casing is capable of sustaining a plastic deformation of at least 25% uni-axial strain.

3. The method of claim 1 wherein the casing forms an intermediate casing located between a surface casing arranged in an upper part of the wellbore and a production casing arranged in a lower part of the wellbore.

4. The method of claim 1, wherein a sealing material in a fluidic state is pumped between the casing and the borehole wall prior to applying said radial force to the casing.

5. The method of claim 1, wherein at least part of the radial force is applied to the casing by moving an expander through the casing, which expander has a larger outer diameter than the inner diameter of the casing.

6. The method of claim 5, wherein the expander is moved through the casing in downward direction.

7. The method of claim 1, wherein at least part of the radial force is applied to the casing by locating a hydraulic expansion tool in the casing and expanding said tool.

8. The method of claim 1, wherein the casing is heated during radial expansion thereof.

* * * * *